US007574802B2

(12) United States Patent
Pennella

(10) Patent No.: US 7,574,802 B2
(45) Date of Patent: Aug. 18, 2009

(54) SHAVING AID DISPENSING DEVICE

(75) Inventor: Andrew J. Pennella, Stamford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 243 days.

(21) Appl. No.: 10/861,658

(22) Filed: Jun. 4, 2004

(65) Prior Publication Data

US 2005/0028370 A1 Feb. 10, 2005

Related U.S. Application Data

(60) Provisional application No. 60/476,989, filed on Jun. 9, 2003.

(51) Int. Cl.
*B26B 21/44* (2006.01)
*B26B 21/40* (2006.01)

(52) U.S. Cl. ..... 30/41; 30/50

(58) Field of Classification Search ..... 30/41, 30/41.5, 51, 60.5, 61, 123.3, 526, 532, 535, 30/537, 538, DIG. 2; 401/261, 266, 267
See application file for complete search history.

(56) References Cited

U.S. PATENT DOCUMENTS 1,828,621 A * 10/1931 Roberts ..... 30/123.3
2,134,960 A * 11/1938 Testi ..... 30/41.5
2,677,883 A * 5/1954 Schallgruber ..... 30/41
2,686,361 A * 8/1954 Resnick et al. ..... 30/41
3,768,161 A * 10/1973 Miller ..... 30/41
4,238,882 A * 12/1980 Harrison, Sr. ..... 30/41
4,712,300 A 12/1987 Hemmeter
4,944,090 A * 7/1990 Sumnall ..... 30/41
5,134,775 A * 8/1992 Althaus et al. ..... 30/41
5,141,349 A * 8/1992 Maguire, Jr. et al. ..... 401/195
5,657,065 A * 8/1997 Lin ..... 347/93
5,903,979 A * 5/1999 Oldroyd ..... 30/41
6,584,690 B2 * 7/2003 Orloff et al. ..... 30/41
6,851,190 B2 * 2/2005 Guimont et al. ..... 30/41
6,886,254 B1 * 5/2005 Pennella ..... 30/41
2003/0014866 A1 1/2003 Orloff et al.
2003/0200660 A1 * 10/2003 Pennella et al. ..... 30/47
2004/0177510 A1 * 9/2004 Pennella ..... 30/41

* cited by examiner

*Primary Examiner*—Boyer D. Ashley
*Assistant Examiner*—Edward Landrum

(57) ABSTRACT

The present invention discloses a shaving aid dispensing device for use with a razor cartridge that includes an inner wall and an outer wall that defines at least one reservoir. The inner wall of the dispensing device further defines an aperture sized for passing a shaving cartridge therethrough. A storage medium is disposed in, and substantially fills, the reservoir(s). A shaving aid material is distributed in the shaving aid storage material. A wick substantially covers the reservoir and is operable to draw the shaving aid from the shaving aid storage material by capillary action. The present invention, therefore, provides a user with a shaving aid dispensing device adjacent to a razor cartridge that readily provides a shaving aid material while the user is shaving.

25 Claims, 4 Drawing Sheets

SHAVING AID DISPENSING DEVICE

CROSS REFERENCE TO RELATED PATENT APPLICATIONS

This application claims priority of provisional application Ser. No. 60/476,989 filed Jun. 9, 2003.

FIELD OF THE INVENTION

The present invention relates generally to shaving devices and, more particularly, to shaving aid devices having a shaving aid dispensing device.

BACKGROUND OF THE INVENTION

Several methods for applying shaving aid materials are known. Typically, a shaving cream, soap, gel, or liquid is applied using either one's hands or a brush. However, methods for applying shaving aid that are integrated into the design of the razor are also known. For example, solid lubricating strips attached to the blade cartridge, and dispensers integrated into the design of the razor that utilize pumps, bellows, valves and/or pistons are commonly known. However, each requires the shaving aid to be in a solid form, or, where the shaving aid is not a solid, the user must actuate some type of a mechanism to dispense the shaving aid. Therefore, it is desirable to provide the user with a shaving aid dispensing device that readily provides a non-solid shaving aid, and does not require the user to actuate any type of mechanism.

SUMMARY OF THE INVENTION

According to one aspect of the present invention, a shaving aid material dispensing device for use with a razor cartridge includes an inner wall and an outer wall that define at least one reservoir, and an aperture sized for passing a razor blade cartridge therethrough. A storage medium is disposed in, and substantially fills, the reservoir. The storage medium is operable to store a shaving aid material. A wick substantially covers the reservoir and is operable to draw the shaving aid material from the storage medium by capillary action.

According to another aspect of the present invention, a shaving device includes a handle, a razor blade cartridge, and the shaving aid dispensing device described above. The shaving aid dispensing device includes an inner wall and an outer wall that define at least one reservoir and an aperture. The razor cartridge is positioned within the aperture of the dispensing device. A storage medium is disposed in, and substantially fills, the reservoir. A shaving aid material is distributed in the storage medium. A wick substantially covers the reservoir of the dispensing device and is operable to draw shaving aid material from the storage medium by capillary action. The shaving cartridge and the shaving aid dispensing device are attached to the handle.

An advantage of the present invention is that the shaving aid material may be in liquid, cream or gel form.

Another advantage of the present invention is that the shaving aid dispensing device does not require the user to operate a mechanism to dispense the shaving aid material from the dispensing device.

A further advantage of the present invention is that shaving aid material can be applied from the present invention "on demand".

Some embodiments of the present invention provide the further advantage of a razor cartridge that incorporates the shaving aid dispensing device.

The foregoing and other advantages of the present invention will become more apparent in light of the following detailed description of the present invention and accompanying drawings.

DETAILED DESCRIPTION OF THE PRESENT INVENTION

Figure 1:
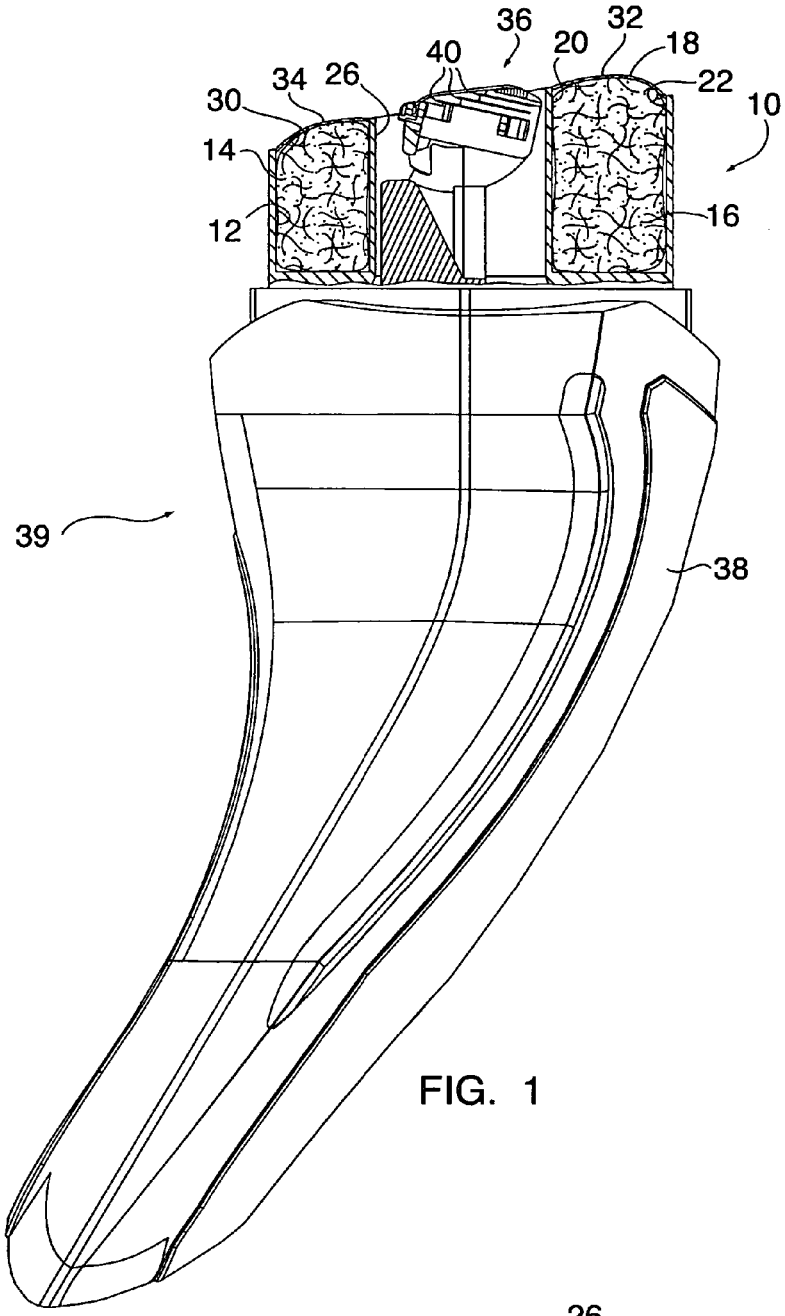
FIG. 1 is a sectional view of a shaving aid dispensing device of the present invention of FIG. 4 along line 1-1.

Referring to FIG. 1, one embodiment of a shaving aid dispensing device 10 of the present invention is shown. The shaving aid dispensing device 10 includes at least one reservoir 12, a storage medium 14, a shaving aid material 16, and a wick 18.

Figure 2:
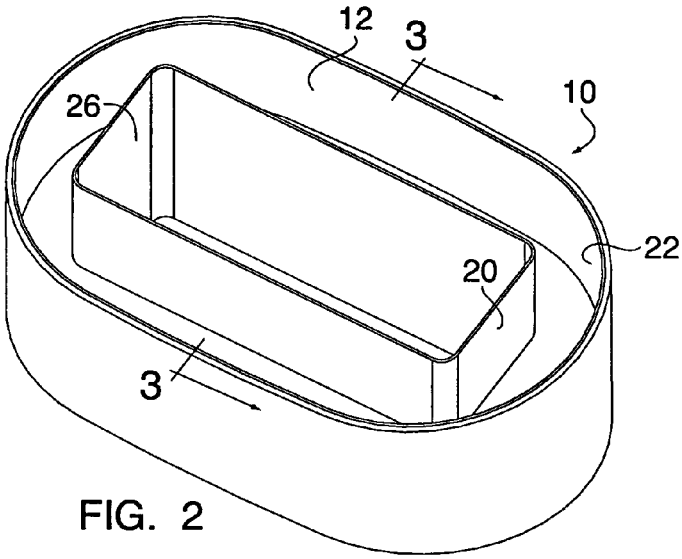
FIG. 2 is a perspective view of a dispensing device having a single reservoir.

Referring to FIG. 2, the dispensing device 10 includes an inner wall 20 and an outer wall 22. The inner wall 20 and outer wall 22 define the at least one reservoir 12. The inner wall 20 further defines an aperture 26 sized for receiving a razor blade cartridge therethrough. The dispensing device 10 is made of any suitable material typically used for constructing shaving devices or shaving aid storage devices (e.g., a polymeric material). The outer shape of the dispensing device 10 is defined by the outer wall 22 and may be of any shape. However, an oval shape has particular utility.

Figure 2A:
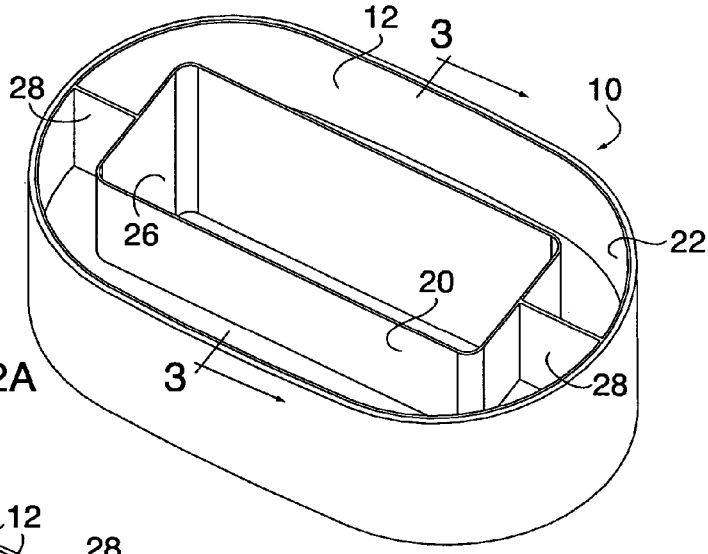
FIG. 2A is a perspective view of a dispensing device having a plurality of reservoirs.
Figure 2B:
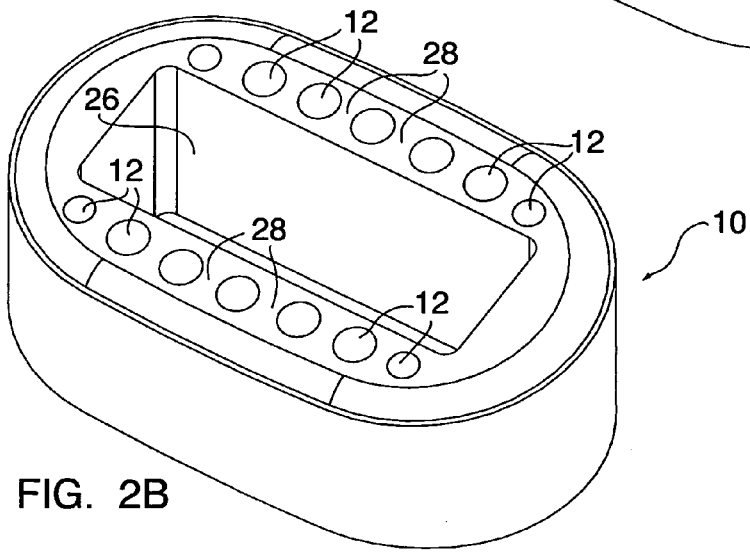
FIG. 2B is a perspective view of a dispensing device having a plurality of reservoirs.

Referring to FIGS. 2A and 2B, the dispensing device 10 may further include one or more reservoir walls 28. The reservoir walls 28 are used to divide the dispensing device 10 into two or more distinct reservoirs 12. Referring to FIG. 2B, the reservoir walls 28 may also be used to reduce the size of the reservoir(s) 12 in order to dispense the shaving aid material 16 at a desired rate and/or create a plurality of reservoirs 12. In embodiments having more than one reservoir 12, the reservoirs 12 may be of different sizes and shapes.

Figure 3:
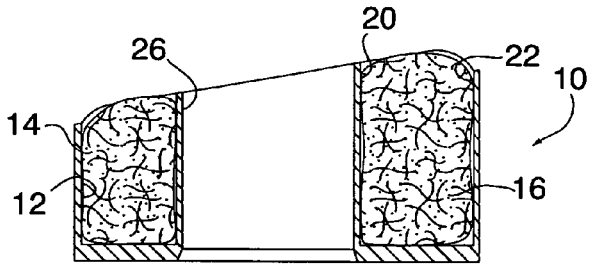
FIG. 3 is a cut away side view of the dispensing device FIG. 2 or 2A along line 3-3 having storage medium therein.

Referring to FIG. 3, the storage medium 14 is disposed in the reservoir 12. The storage medium 14 may be made of any suitable material. Fibrous materials are an example of an acceptable storage medium 14 and have particular utility. In a preferred embodiment, the storage medium 14 is a spun or extruded fiber, such as wool, fiberfill, cellulose or acetate. In embodiments where more than one reservoir 12 is present, more than one type of storage medium 14 may be utilized. Typically, the storage medium 14 substantially fills the reservoir 12 in which it is located.

Continuing to refer to FIG. 3, the shaving aid material 16 is distributed in the storage medium 14. The term "shaving aid"

as used herein is intended to refer to any non-solid substance that is known to aid in the preparation for, or treatment of the skin before, during, or after shaving. For example, commonly known non-solid shaving aid materials 16 include shaving creams, soaps, gels and liquids, as well as after shave liquids, lotions, creams and gels. This list is not to be considered all-inclusive of non-solid shaving aid materials 16 known to those skilled in the art. In embodiments where more than one reservoir 12 is present, such as in FIGS. 2A and 2B, various shaving aid materials 16 may be distributed in the storage mediums 14 of the different reservoirs 12.

Figure 4:
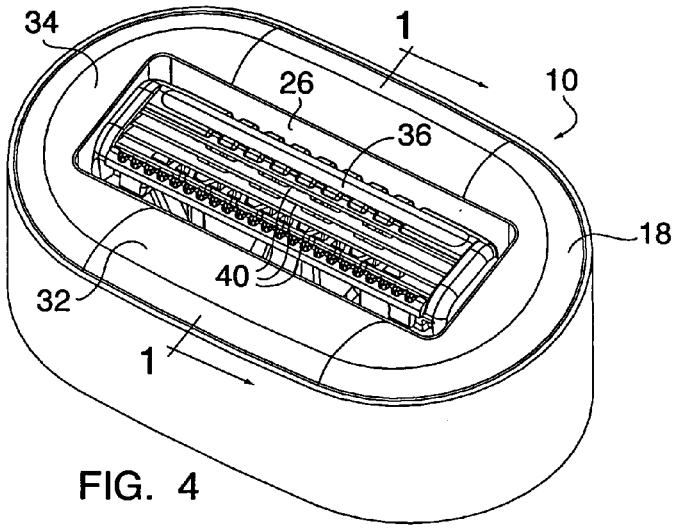
FIG. 4 is a perspective view of the shaving aid dispensing device of the present invention.

Referring now to FIG. 4, a wick 18 having an inner surface 30 (as shown in FIG. 1) and an outer surface 32 is placed on the dispensing device 10, substantially covering the reservoir 12. The inner surface 30 of the wick 18 is positioned so that it remains in contact with the storage medium 14 (as shown in FIG. 1). The wick 18 is operable to draw the shaving aid material 16 from the storage medium 14 by capillary action to the outer surface 32 of the wick 18. The term "capillary action," as used herein, refers to the natural action of a non-solid through a wick 18 caused by adhesive and cohesive forces between the two substances, wherein the non-solid material travels through the wick. The porosity of the wick 18 and the properties of the shaving aid material 16 are factors that influence the rate at which the shaving aid material 16 is drawn through the wick 18. The wick 18 is preferably made of fibrous material. Commercially available bonded fiber products, such as those marketed by Filtrona International Ltd., of Colonial Heights, Va., are suitable for making the wicks 18 of the present invention and can be manufactured to facilitate creating a desired flow rate for any particular shaving aid material 16. In some applications, the wick 18 may be made of a substantially similar material as the storage medium 14.

Figure 4A:
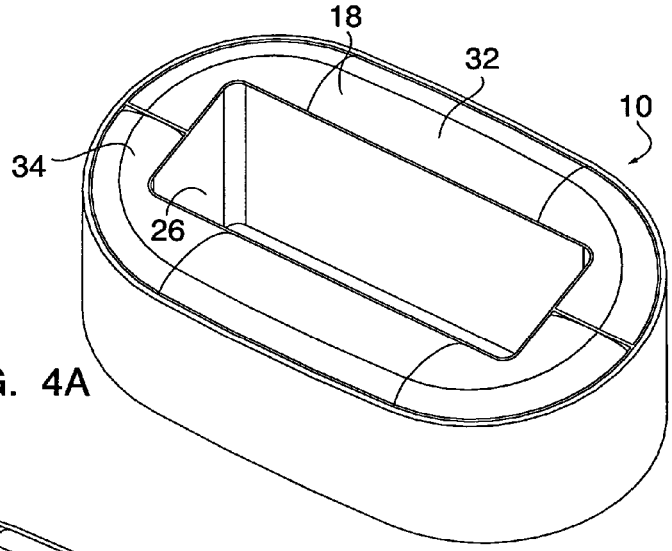
FIG. 4A is a perspective view of a shaving aid dispensing device having a plurality of reservoirs.
Figure 4B:
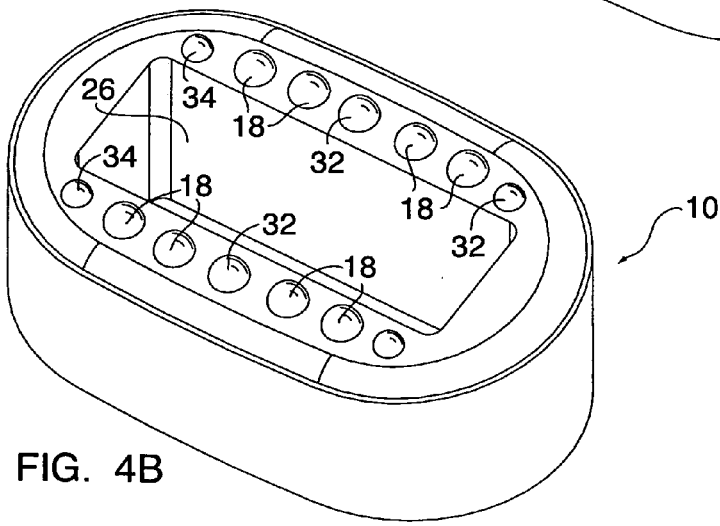
FIG. 4B is a perspective view of a shaving aid dispensing device having a plurality of reservoirs.

In embodiments where more than one reservoir 12 is present, such as in FIG. 4A and 4B, a plurality of wicks 18 of the same or different materials may be utilized.

Depending on the intended use of the end product, the wick 18 may be affixed over the reservoir 12 in a manner such that it is not removable during ordinary use. Alternatively, the wick 18 is selectively removable from the dispensing device 10. In either embodiment, a depleted storage medium 14 can be replenished with additional shaving aid material 16. For example, a syringe containing shaving aid material 16 can be inserted through the wick 18 and into the depleted storage medium 14, thereby dispersing addition shaving aid material 16 into the original storage medium 14. In embodiments where the wick 18 is selectively removable from the dispensing device 10, the wick 18 can be removed and the shaving aid material 16 dispersed in the exposed storage medium 14. Alternatively, once the wick 18 is removed, the storage medium 16 can be selectively replaced with a new storage medium 14 filled with shaving aid material 16 and, optionally, a new wick 18 if desired.

The wick 18 is also preferably moldable and shaped to have an outwardly rounded outer surface 34 as shown, for example, in FIGS. 4 and 4A. The outwardly rounded surface 34 encourages contact between the surface to be shaved and the outer surface 32 of the wick 18, thereby causing the wick 18 to draw the shaving aid material 16 from the storage medium 14, through the wick 18.

Figure 5:
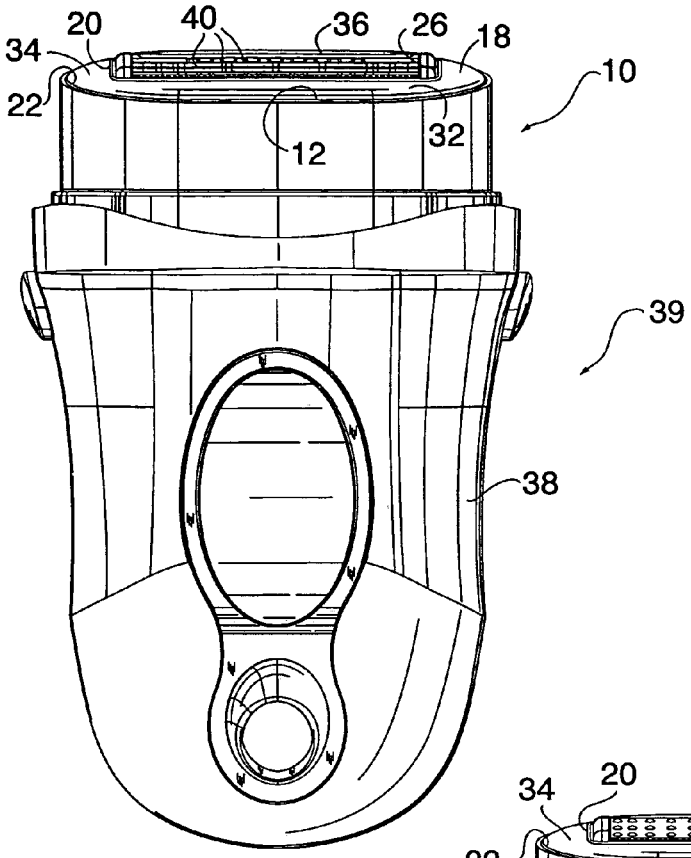
FIG. 5 is a perspective view of the present invention shaving device.

Referring to FIG. 5, according to another aspect of the present invention, a shaving device 39 is provided that includes the shaving aid dispensing device 10 described above, a razor cartridge 36 and a handle 38.

The razor cartridge 36 has at least one cutting edge 40 and may be attached to the dispensing device 10, or the handle 38. In either embodiment, the razor cartridge 36 is positioned in the aperture 26 and is substantially surrounded by the inner wall 20. The razor cartridge 36 is positioned in such a manner that at least a portion of the cutting edge 40 protrudes outwardly through the aperture 26. The outer surface 32 of the wick 18 should be substantially adjacent to the cutting edge (s) 40 of the razor cartridge 36. Such positioning allows the user to place the outer surface 32 of the wick 18 and the cutting edge(s) 40 of the razor cartridge 36 in contact with the surface to be shaved at the same time.

Figure 6:
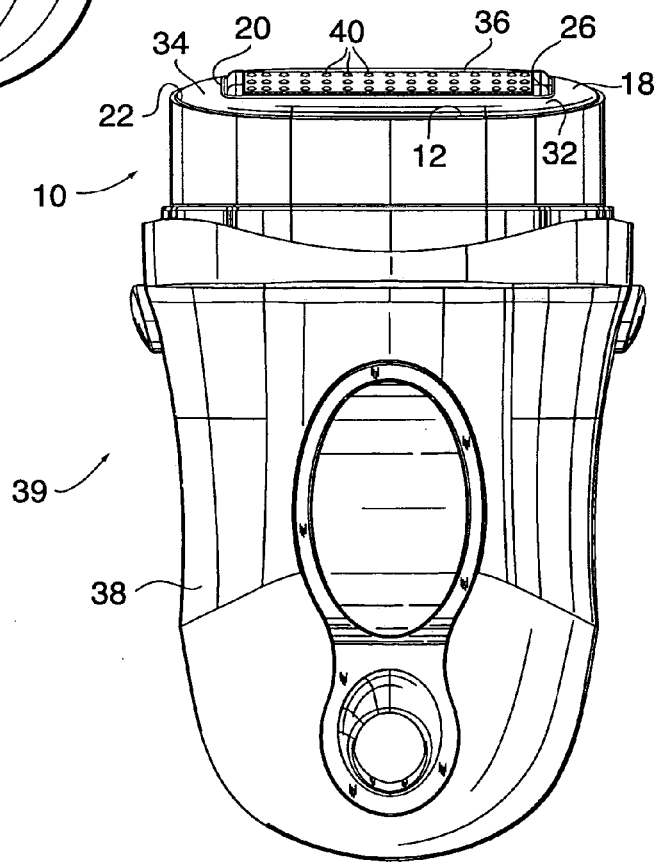
FIG. 6 is a perspective view of the present shaving device having multi-directional cutting edges.

In some embodiments, the razor cartridge 36 has a plurality of cutting edges 40. The cutting edges 40 of the razor cartridge 36 may be aligned to cut in the same direction. Alternatively, the cutting edges 40 of the razor cartridge 36 may be oriented so that at least one cutting edge 40 is aligned to cut in a substantially different direction than at least one other cutting edge 40, as shown in FIG. 6. Although the multi-direction cutting edges 40 are shown as being round in FIG. 6, different geometrical shapes, or orientations of straight cutting edges may be utilized alternatively to achieve multi-directional cutting.

Referring to FIG. 5, the handle 38 may be made of any suitable material and shaped in any suitable manner. However, molded plastic handles 38 shaped to allow the user to easily grasp the handle 38 have particular utility.

The razor cartridge 36 may be attached to the handle 38 such that it is not removable under during normal use. Alternatively, the razor cartridge 36 is selectively removable from the handle or the dispensing device 10. Likewise, the shaving aid dispensing device 10 may be attached to the handle 38 such that the shaving aid dispensing device 10 is not intended to be removed during ordinary use. Alternatively, and depending on the intended end use of product, the shaving aid dispensing device 10 may be removably attached to the handle 38.

In operation, the user brings the outer surface 32 of the wick 18 and the cutting edge(s) 40 of the razor cartridge 36 in contact with the surface to be shaved. As the user moves the shaving device 39 across the area to be shaved, the wick 18 operates to draw the shaving aid material 16 from the storage medium 14 through the wick 18 by capillary action thereby delivering the shaving aid material 16 directly to the area being shaved. Simultaneously, as the user moves the shaving device 39 across the area to be shaved, the cutting edge(s) 40 operate to shave the undesired hair from the area.

While the present invention has been illustrated and described with respect to a particular embodiment thereof, those of ordinary skill in the art should appreciate that various modifications to this invention may be made without departing from the spirit and scope of the present invention.

The invention claimed is:

1. A shaving aid dispensing device, comprising:

at least two reservoirs defined by an inner wall and an outer wall, wherein the reservoirs are separated by reservoir walls;

wherein the inner wall further defines an aperture for passing a razor cartridge therethrough;

a storage medium disposed in each of the reservoirs;

a shaving aid material distributed in each of the storage mediums; and a wick substantially covering each of the reservoirs, wherein the wicks are operable to draw the shaving aid materials from the storage mediums by capillary action; and wherein the wicks and the storage mediums are different materials.

2. The shaving aid dispensing device of claim 1 wherein the storage mediums substantially fill the reservoirs.

3. The shaving aid dispensing device of claim 2 wherein the storage mediums are in contact with an inner surface of the wicks.

4. The shaving aid dispensing device of claim 2 wherein the storage mediums are at least partially made of a fibrous material.

5. The shaving aid dispensing device of claim 3 wherein the storage mediums are at least partially made of an extruded fiber.

6. The shaving aid dispensing device of claim 3 wherein the storage mediums are at least partially made of a spun fiber

7. The shaving aid dispensing device of claim 1 wherein the wicks are at least partially made of fibrous material.

8. The shaving aid dispensing device of claim 1 wherein the wicks are moldable.

9. The shaving aid dispensing device of claim 8 wherein the wicks are molded to have an outwardly rounded outer surface.

10. The shaving aid dispensing device of claim 1 wherein the wicks are removably attached to the dispensing device.

11. The shaving aid dispensing device of claim 1 wherein the wicks are attached to the dispensing device such that the wicks are not intended to be removed during ordinary use.

12. The shaving device of claim 1 wherein said reservoirs contain different shaving aid materials.

13. The shaving device of claim 1, wherein said reservoirs are specifically located forward of the blades, while other reservoirs are located aft of the blades.

14. The shaving device of claim 13 wherein said at least one reservoir forward of the blades contains a lubricating shaving aid, while said at least one reservoir aft of the blades contains a skin conditioning shaving aid.

15. A shaving device, comprising:

a razor cartridge having at least one cutting edge;

a shaving aid dispensing device having an inner wall and an outer wall that defines at least two reservoirs, wherein the reservoirs are separated by reservoir walls;

wherein the inner wall further defines an aperture for passing the shaving cartridge therethrough;

a storage medium disposed in each of the reservoirs;

a shaving aid material distributed in each of the storage mediums; and a wick substantially covering each of the reservoirs, wherein the wicks are operable to draw the shaving aid materials from the storage mediums by capillary action; and wherein the wicks and the storage mediums are different materials.

16. The shaving device of claim 15 wherein the cutting edge of the razor cartridge is substantially adjacent to an outer surface of at least one of the wicks.

17. The shaving device of claim 15 further comprising a handle.

18. The shaving device of claim 17 wherein the storage mediums may be externally replenished.

19. The shaving device of claim 17 wherein the razor cartridge has more than one cutting edge.

20. The shaving device of claim 19 wherein the cutting edges are aligned to shave in substantially the same direction.

21. The shaving device of claim 19 wherein at least one cutting edge is aligned in a substantially different direction relative to at least one other cutting edge.

22. The shaving device of claim 17 wherein the wicks are selectively removable from over the reservoirs.

23. The shaving device of claim 22 wherein the storage mediums are selectively replaceable with new storage mediums.

24. A shaving aid dispensing device, comprising:

at least two reservoirs, wherein the reservoirs are separated by reservoir walls, and are defined by an inner and an outer wall, wherein the inner wall further defines an aperture for passing a razor cartridge therethrough;

a storage medium disposed in each of the reservoirs; and a wick substantially covering each of the reservoirs, wherein the wicks are operable to draw shaving aid materials from the storage mediums by capillary action; and wherein the wicks and the storage mediums are different materials.

25. A shaving device, comprising:

a razor cartridge having at least one cutting edge;

a shaving aid dispensing device having an inner wall and an outer wall that define at least two reservoirs, wherein the reservoirs are separated by reservoir walls;

wherein the inner wall further defines an aperture for passing the shaving cartridge therethrough;

a storage medium disposed in each of the reservoirs; and a wick substantially covering each of the reservoirs, wherein the wicks are operable to draw shaving aid materials from the storage mediums by capillary action; and wherein the wicks and the storage mediums are different materials.

* * * * *